United States Patent [19]

Hatcher

[11] 4,256,344

[45] Mar. 17, 1981

[54] CONCRETE SURFACING MACHINE

[75] Inventor: Cecil W. Hatcher, West Covina, Calif.

[73] Assignee: Concrete Safety Equipment, Inc., Torrance, Calif.

[21] Appl. No.: 970,525

[22] Filed: Dec. 18, 1978

[51] Int. Cl.[3] ..... E01C 23/09

[52] U.S. Cl. ..... 299/39; 104/122; 180/7 R; 180/209

[58] Field of Search ..... 299/39–41, 299/36–38; 173/24, 32; 104/122, 183, 169; 105/161; 254/147

[56] References Cited

U.S. PATENT DOCUMENTS

| | | | |
|---|---|---|---|
| 472,177 | 4/1892 | Palmer | 254/147 X |
| 1,630,422 | 5/1927 | Gillespie | 299/39 |
| 3,291,532 | 12/1966 | Hatcher | 299/39 |
| 3,387,891 | 6/1968 | Simms et al. | 299/39 |
| 3,663,061 | 5/1972 | Miller | 299/39 |
| 4,049,131 | 9/1977 | Schrader et al. | 104/122 X |

*Primary Examiner*—Ernest R. Purser

[57] ABSTRACT

A concrete surfacing machine has a carriage mounting a concrete surfacing means, such as a rotary cutter, between front and rear wheels of the carriage which are independently adjustable in both the lengthwise and vertical directions of the carriage to accommodate surfacing of both flat and curved concrete surfaces and to effect both vertical adjustment and leveling of the surfacing means. The machine is equipped with a winch for propelling the carriage upwardly along an inclined surface and braking the carrriage during downward movement along such a surface and with a novel trolley suspension arrangement for restraining the carriage laterally on a surface which slopes laterally of the carriage.

18 Claims, 11 Drawing Figures

CONCRETE SURFACING MACHINE

BACKGROUND OF THE INVENTION

1. Field of the Invention

This invention relates generally to concrete working machines and more particularly to a novel concrete surfacing machine.

2. Discussion of the Prior Art

In the context of this invention, concrete surfacing refers in a broad sense to performing some type of machining operation on a concrete surface by movement of an appropriate concrete machining tool along the surface. In a more limited sense, concrete surfacing refers to smoothing or planing a concrete surface by movement of a powered rotary surfacing or planing cutter along the surface. A present useful application of the invention, for example, involves surfacing or planing the floors of concrete dam spillways.

In this regard, it has found that high velocity water flow over even small bumps and the like on the floor of a concrete dam spillway causes damage to the spillway in the form of cracking, chipping and other erosion of the concrete. It is thought that this is due to low pressure or vacuum regions and impact forces which are created by the water flowing at high velocity over the bumps. In any event, if this problem is not corrected by removing the bumps, the spillway can suffer irreparable damage and become totally unusable in a relatively short period of time.

Spillway surfacing involves certain unique problems to which this invention is addressed. One problem resides in the fact that some spillway surfaces which require surfacing are inclined often quite steeply, lengthwise and/or laterally of the spillway. As a consequence, a surfacing machine must be capable of operating on steep slopes and hence must have a propulsion or drive system capable of effecting controlled and safe movement of the machine up and down such slopes. Moreover, if the surface slopes laterally of the machine, the latter must be restrained against slipping sideways.

In spillway surfacing operations, a surfacing machine may be required to move back and forth along or across the spillway without turning around at the end of each pass. Accordingly, a spillway surfacing machine should be reversible, that is capable of propulsion in either direction of movement. In addition a dam spillway may have both relatively flat concrete surfaces and curved concrete surfaces which require surfacing. A spillway surfacing machine must thus be capable of operating on, i.e. surfacing, both flat and curved surfaces. As will appear from the later description, each pass of a surfacng machine may involve movement of the machine along both flat and curved surfaces. Accordingly, a spillway surfacing machine must not only be capable of operating on both flat and curved surfaces but, further, must be capable of rapid transition from one shape of surface to another without time consuming adjustment of the machine.

At this point, it is significant to note that while the present invention is concerned primarily with dam spillway surfacing, it is not to be construed as limited to this particular application. In this regard, it will be recognized that the above discussed concrete surfacing problems are not limited to spillway surfacing.

SUMMARY OF THE INVENTION

According to its more limited aspects, this invention provides a concrete surfacing machine which satisfies all the foregoing requirements and hence is uniquely adapted for use as a concrete spillway surfacing machine for cutting or planing from the spillway surface bumps and the like which trigger water damage to many spillways. It will become readily evident as the description proceeds, however, that the invention is not limited to this particular use.

Simply stated, the concrete surfacing machine of the invention has a carriage with front and rear wheels at its ends which support the carriage for movement along a surface to be worked. Mounted on this carriage between the wheels is a surfacing means, which, in the case of a concrete surface smoothing or planing machine of the invention suitable for dam spillway surfacing, may be a motor driven rotary surfacing or planing head, such as a rotary cylindrical cutter as cutting drum. The carriage has a propulsion or drive means for propelling the carriage along the surface. For spillway surfacing operations, this drive means may include a drive system for the carriage wheels for use on relatively level surfaces and a winch drive for use on slopes. A feature of the invention concerned with machine operation on surfaces which slope laterally of the machine, such that the surfacing machine is subject to a sideway slipping force, resides in a unique guide rail and trolley arrangement for laterally restraining the carriage while premitting its free fore and aft movement.

According to another feature of the invention, the concrete surfacing machine is reversible, that is it can be propelled in both directions along a concrete surface to be machined. This permits the machine to move back and forth along a dam spillway without turning around at the end of each pass.

Yet another feature of the invention involves independent adjustment of the carriage wheels both vertically and lengthwise of the machine. This permits the wheel spacing to be increased for operation on relatively flat surfaces and reduced for operation on curved surfaces. Such wheel adjustment is also effective to vertically adjust and level the concrete surfacing head.

Other features and advantages of the invention will become evident as the description proceeds.

DESCRIPTION OF THE PREFERRED EMBODIMENT

Figure 1:
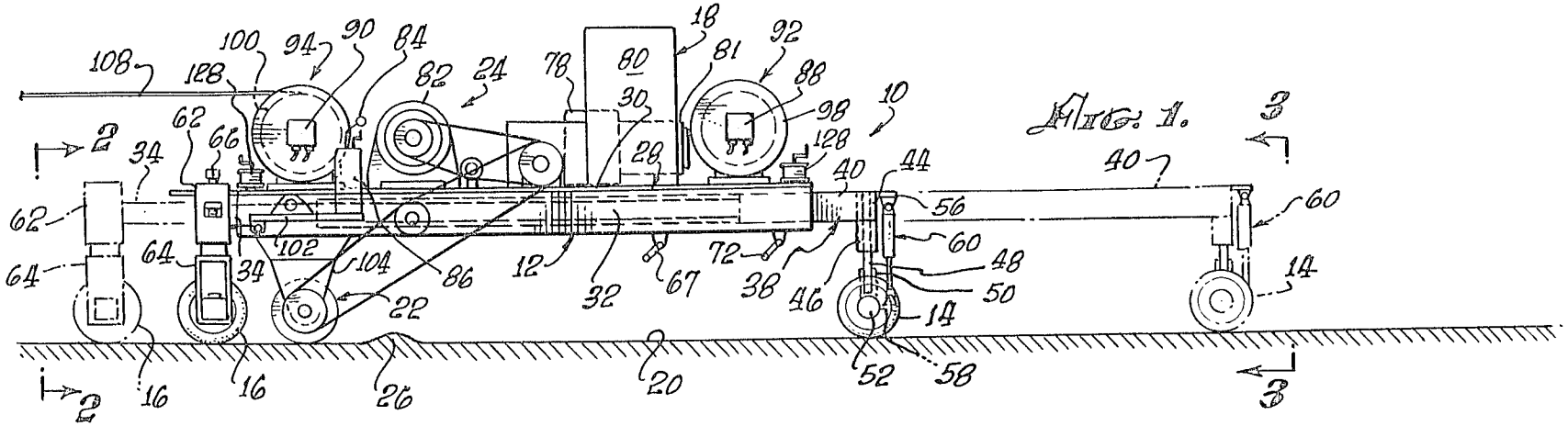
FIG. 1 is a side elevation of a concrete surfacing machine according to the invention.
Figure 3:
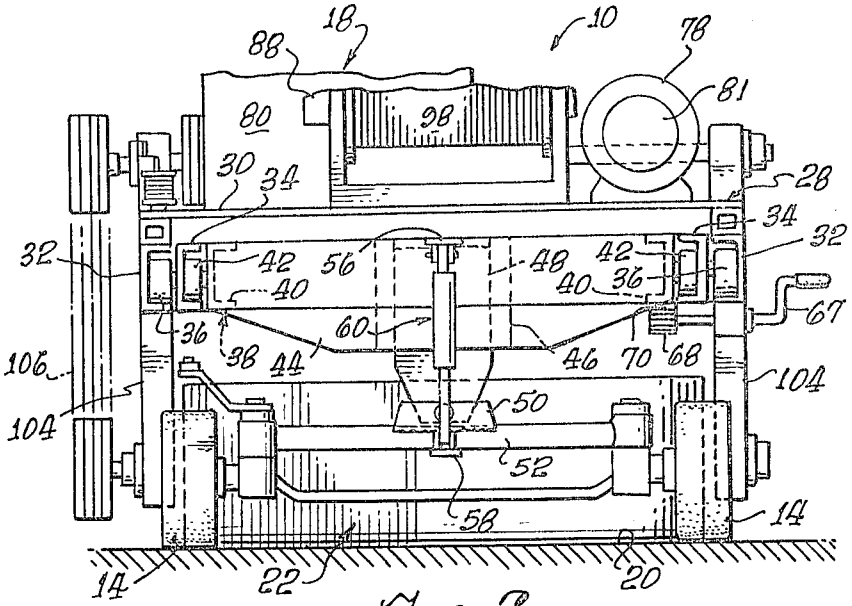
FIG. 3 is an enlarged right hand end view of the machine looking in the direction of the arrows on line 3—3 in FIG. 1.
Figure 2:
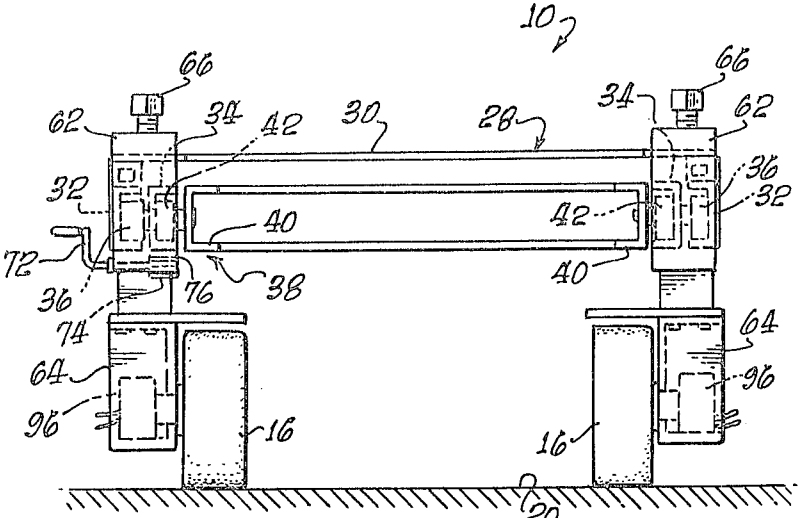
FIG. 2 is an enlarged left hand end view of the machine looking in the direction of the arrows on line 2—2 in FIG. 1.
Figure 4:
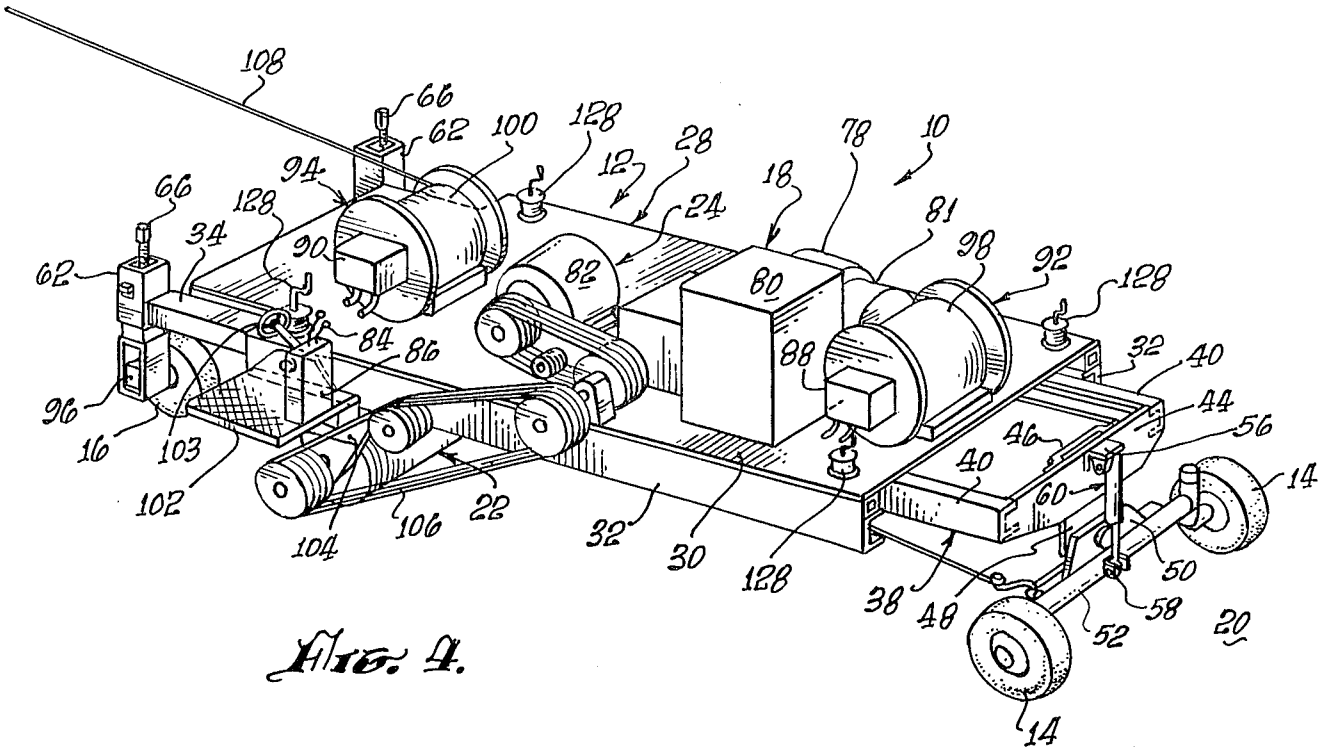
FIG. 4 is a perspective view of the machine.

Referring first to FIGS. 1–4, the illustrated concrete surfacing machine 10 of the invention has a carriage 12 with front and rear wheels 14, 16. The carriage has propulsion means 18 for driving the carriage in either direction along a concrete surface 20 to be worked, i.e. surfaced. Mounted on the carriage between its wheels 14, 16 is a concrete surfacing means 22 driven in a surfacing motion by drive means 24 on the carriage. In operation of the machine, the carriage 12 is propelled along the surface 20 with the surfacing means 22 in contact with the surface. The surfacing means 22 is driven in the surfacing motion to machine the surface. As noted earlier, the concrete surfacing machine of the invention may be designed to perform a variety of surfacing operations. The particular machine shown is arranged to cut or plane bumps 26 from the concrete surface 20. To this end, the surfacing means 22 of the machine is a rotary cylindrical cutter which is driven in rotation by the surfacing drive means 24 on an axis transverse to the length of the carriage.

More specifically, the illustrated machine is uniquely designed for surfacing concrete dam spillways to remove from the spillway surfaces bumps which promote water damage to the spillways in the manner explained earlier. A feature of the invention which adapts the machine to this spillway surfacing application resides in the fact that its wheel base, i.e. the front to rear wheel spacing, is adjustable, and the machine is propelled in a manner which enables the machine to move and operate with an effective surfacing on both flat and curved surfaces (convex and concave) and along the inclined surfaces of a spillway. The machine can also move from one sloping surface to another of different grade or contour with relatively simple adjustment of the machine.

With this preliminary brief description in mind, the illustrated concrete surfacing machine will be described in detail. The machine carriage 12 comprises a base frame 28 including a main, platform-like frame portion 30 having lower side channels 32 which open inwardly toward one another. Extending longitudinally along the inner open sides of the frame channels 32 and beyond the rear end of the frame platform 30 are rear wheel mounting channels 34. Rear wheel channels 34 open inwardly toward one another and away from the frame channels 32 and mount rollers 36 which ride in the latter channels to support the wheel channels for endwise extension and retraction as indicated in full and phantom lines in FIG. 1. The rear carriage wheels 16 are mounted on the rear ends of the wheel channels in the manner explained presently.

Projecting beyond the front end of the frame platform 30 is a front wheel mounting frame 38. Wheel frame 38 has longitudinal side channels 40 which extend along the inner sides of the rear wheel mounting channels 34. Front wheel frame channels 40 open inwardly toward one another and away from the rear wheel channels 34 and mount rollers 42 which ride in the rear wheel channels to support the front wheel frame for extension and retraction, as indicated by full and broken lines in FIG. 1.

At the front end of the front wheel mounting frame 38 is a cross plate 44. A vertical guide 46 at the front end of this cross plate slidably receives a slide plate 48 pivotally attached at its lower end to an upstanding pivot bearing plate 50 on the center of a front wheel axle 52. The front carriage wheels 12 are turnably mounted on the ends of this axle. Connected to and acting between an upper thrust bracket 56 rigid on the front wheel frame cross plate 44 and a lower thrust bracket 58 rigid on the front wheel axle 52 is a hydraulic actuator 60 which is selectively controllable in the manner to be explained presently to raise and lower the front end of the carriage frame 28.

Rigid on the rear ends of the rear wheel mounting channels 34 are vertical guides 62. Slidable in and projecting below these guides are rear wheel supports 64 which turnably mount the rear carriage wheels 16. Bolts 66 threaded in the upper ends of the guides 62 and engaging the upper ends as the rear wheel supports 64 are adjustable to vertically adjust the rear wheels 16 relative to the carriage frame 28. The front wheel frame 38 is longitudinally adjustable relative to the frame platform 30 to extend and retract the front carriage wheels 14 relative to the platform by rotation of a crank 67 which turns a pinion 68 meshing with a rack 70 on the bottom side of one side channel 40 of the front wheel frame. The rear wheel mounting channels 34 are longitudinally adjustable relative to the frame platform 30 to extend and retract the rear carriage wheels 16 relative to the platform by rotation of a crank 72 which turns pinion 74 meshing with racks 76 on the bottom side of one of channels 34. From this description it is evident that the carriage frame 28 is extensible and contractable in length to adjust the spacing between the front and rear carriage wheels 14, 16. The front and rear wheels are independently adjustable to adjust the relative position of each with respect to the frame platform 30. The frame platform 30 is adjustable in height and attitude relative to the concrete surface 20 by adjustment of the front hydraulic actuator 60 and/or the rear wheel adjusting screws 66.

As noted earlier, the carriage 12 is equipped with propulsion means 18. While any suitable type of propulsion means may be employed, that illustrated (FIGS. 1, 3, and 4) is an hydraulic propulsion means including a motor-driven hydraulic pump 78, an hydraulic fluid reservoir or tank 80 and a propulsion electrical motor 81. The pump is driven by the electrical motor 81 which is powered via an electrical power cable (not shown) or by a engine-driven generator (not shown). Pump 78 is connected through control valves 84 on a control console 86 to the hydraulic drive motors 88, 90 of a pair of hydraulic propulsion winches 92, 94 are the front and rear ends of the carriage platform 30, to hydraulic drive motors 96 for the rear carriage wheels 16, and to the front elevation actuator 60. The control valves 84 are operable to selectively supply hydraulic fluid under pressure to the winch motors 88, 90 and the rear wheel motors 96 in such a way as to effect selective driving of the winch drums 98, 100 and the rear carriage wheels 16 in either direction. As explained presently, the propulsion winches 92, 94 are used to propel and brake the carriage on slopes. The rear wheel motors 96 are used to propel the carriage on relatively level surfaces. The control valves are also operable to effect selective extension and retraction of the front actuator 60 for raising and lowering the front end of the carriage frame 28.

Control console 86 is mounted on an operator's platform 102. This platform may be pivotally mounted on one side of the carriage 12 and counterbalance to assure a horizontal position regardless of the fore and aft attitude of the carriage. In addition to the control valves 84 this console has a steering wheel 103 which forms part of a hydraulic steering system for the front carriage wheels 14.

The surfacing cutter 22 is located below the rear end of the carriage frame platform 30 and extends transverse to the length of the carriage. The cutter is rotatably mounted at its ends on a pair of bearing brackets 104 depending from the underside of the platform. The cutter drive means 24 comprises a carriage motor 82 and a belt drive 106 interconnecting the cutter and the carriage motor. If so desired in applications where power considerations permit, the carriage motor 82 may also power the propulsion pump 78, and the drive chain may include a clutch for selectively disengaging the cutter from the motor, so that the motor can continue to operate the hydraulic pump 78 without driving the cutter.

In normal operation of the machine to surface a relatively flat concrete surface, both the front carriage wheels 14 and the rear wheels 16 are fully extended. This provides a large spacing between the front and rear wheels as is desirable for concrete surfacing to remove bumps 26. In this regard, it will be understood that with such a large wheel spacing and relatively close proximity of the cutter to the rear wheels, a given vertical displacement of the front end of the carriage as the front wheels ride over a bump, for example, produces minimum vertical displacement of the cutter. According the described carriage adjustment is the optimum adjustment for surfacing flat concrete surfaces. On the other hand, when surfacing curved surfaces, such as concave or convex surfaces, the carriage wheels 14, 16 are contracted to provide the machine with a relatively short wheel base which enables the machine to conform more closely to the surface curvature and locates the cutter in more nearly proper cutting relation to the surface.

It will be recalled that this extension and retraction of the wheels is accomplished by turning the carriage frame cranks 67, 72. The surfacing cutter 22 is located at the proper elevation relative to the concrete surface 20 to be surfaced by adjustment of the front elevation actuator 60 and/or the rear wheel elevation adjustment screws 66. For a surfacing or planing operation, the proper cutter height adjustment is that at which the bottom of the cutter just touches or is just slightly spaced from the level concrete surface. The cutter may be leveled, i.e. its axis made parallel to the concrete surface, by individual vertical adjustment of the rear wheels. If the vertical position of the front and rear wheels relative to the plane of the frame platform are not the same, fine height and leveling adjustments of the cutter may be made by horizontal extension and retraction of the wheels.

The actual concrete surfacing operation involves movement of the carriage 12 along the concrete surface 20 to be worked while the cutter 20 is driven in rotation to plane the surface. On a relatively level surface, the carriage may be propelled along the surface by the rear wheel hydraulic drive motors 96. On uphill slopes, the carriage is propelled by the forward winch 92. This accomplished by anchoring the end of the cable propulsion 108 at the top of the slope and then driving the winch drum 98 by its hydraulic drive motor 88 in a direction to winch the cable on the drum and thereby effectively pull the carriage up the slope. This uphill propulsion of the carriage by the winch may be aided by the rear wheel drive motors 96 if desired. On downhill slopes, the cable of the rear winch 94, may be anchored at the top of the slope and latter winch operated in a manner to unwind the cable from the winch drum 100 at a controlled rate to produce a controlled braking force on the carriage. This downhill movement of the carriage occurs by the force of gravity aided, if necessary, by the rear wheel drive motors 96.

Figure 5:
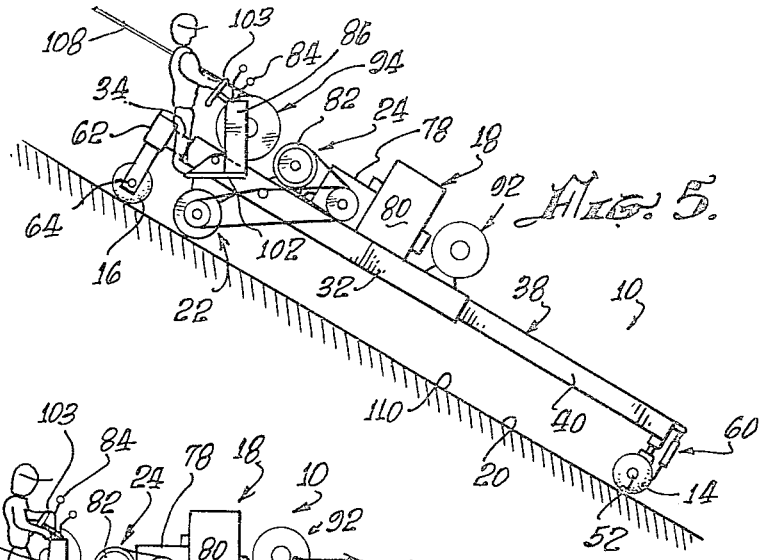
FIGS. 5–7 illustrate different operating modes of the machine.
Figure 6:
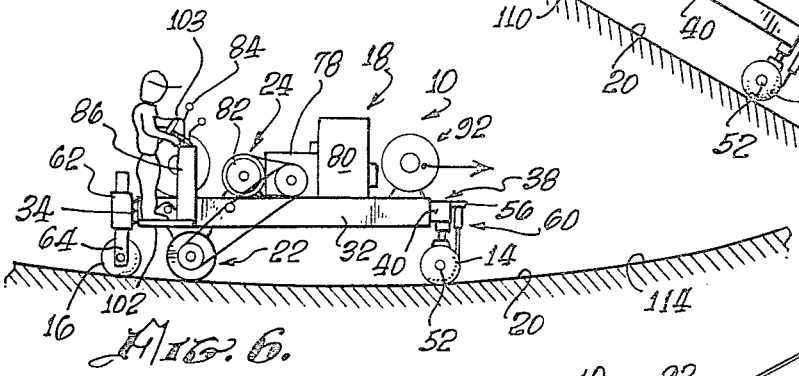
Figure 7:
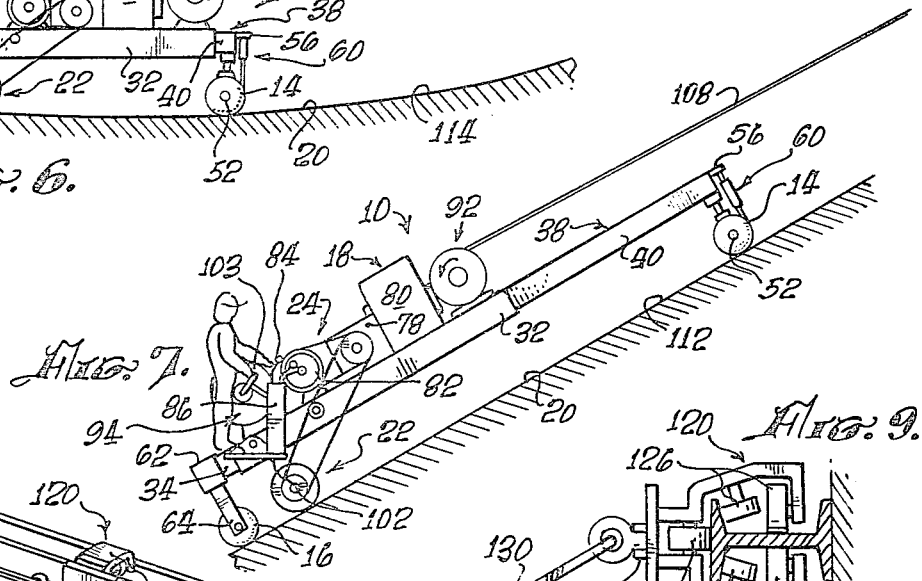

As noted earlier, the concrete surfacing machine of the invention may be utilized for a variety of purposes. A present usefull application of the machine is surfacing concrete dam spillways to remove bumps which promote damage to the spillways in the manner explained earlier. In this regard, attention is directed to FIGS. 5–7 which illustrate three different surfaces which are commonly encountered in such dam spillway surfacing operation. FIGS. 5 and 7 are downhill and uphill slopes 110, 112 respectively, and FIG. 6 is a concave transition surface 114 between these slopes. The concrete surfacing machine 10 of the invention is utilized to surface the three spillway surfaces in FIGS. 5–7 by downward movement of the machine along the slope 110 in FIG. 5, generally horizontal movement across the concave transition surface 114 in FIG. 6, and upward movement along the slope 112 in FIG. 7.

As explained earlier, and shown in the drawings, the rear winch 94 is utilized to brake the carriage 12 during its downhill surfacing motion across the slope 110 in FIG. 5. The front winch 92 is utilized to pull the carriage upwardly along the slope 112 in FIG. 7. The rear wheel drive motors 96 are employed to drive the carriage across the concave transition surface 114 in FIG. 6. The slopes 110 and 112 are relatively flat so that the front and rear wheels 14, 16 are extended to provide the carriage with a maximum wheel base as preferred for surfacing or planing of such flat surfaces. When traversing the concave transition surface 114, the carriage wheels 14, 16 are telescoped inwardly to contract the carriage 12 in length and thereby minimize the spacing between the front and rear wheels. This enables the surfacing machine to conform more closely to the curvature of the transition surface and thereby to more accurately plane the surface. The cutter is vertically adjusted as necessary in the manner explained earlier.

Figure 9:
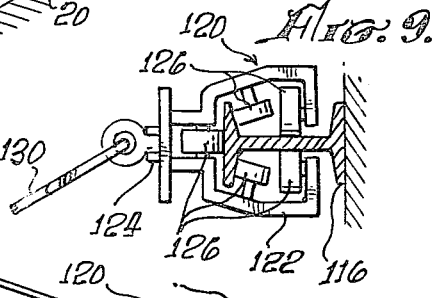
FIG. 9 is an enlarged section taken on line 9—9 in FIG. 8.
Figure 8:
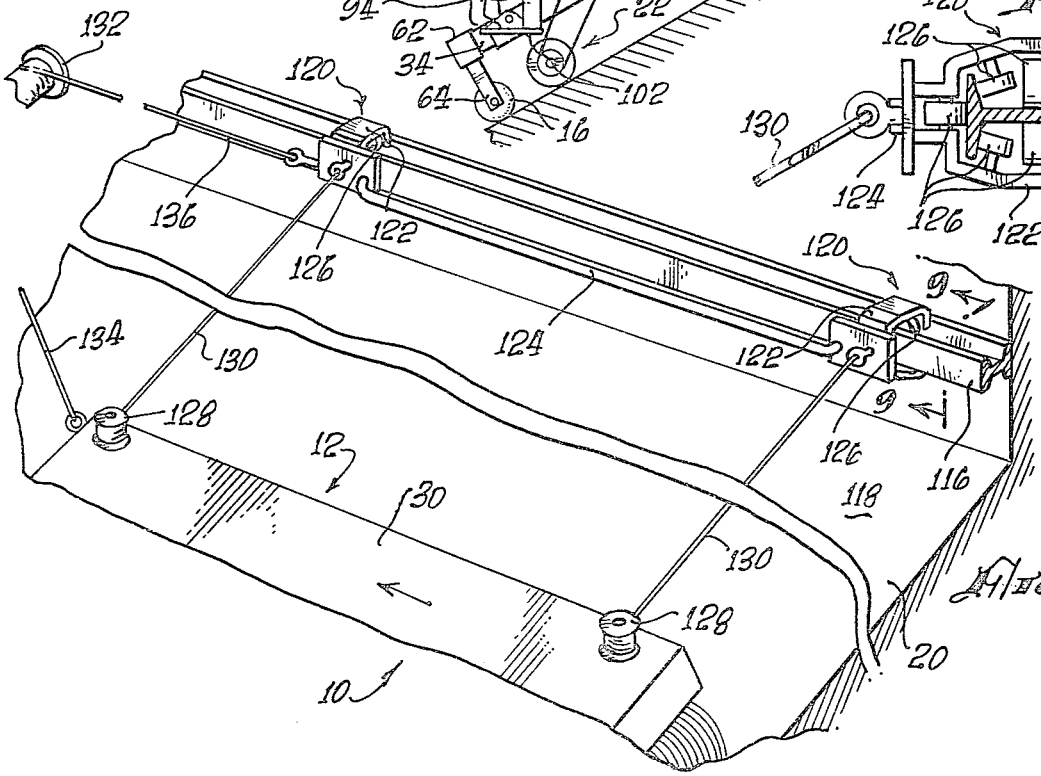
FIG. 8 is an enlarged perspective view illustrating a guide rail and trolley arrangement for laterally restraining the machine carriage during its movement along a surface which slopes laterally of the carriage.

In some cases, it may be desirable or necessary for the present concrete surfacing machine to operate along a surface which slopes laterally of the direction in which the machine is to move. The guide rail and trolley arrangement of FIGS. 8 and 9 may be utilized in this situation to restrain the machine carriage against slipping sideways along the surface. This arrangement includes a guide rail 116 which is anchored to the sloping surface 118 to be planed with the rail extending in the direction of movement of the carriage along the surface. Movable along this rail are a pair of trolleys 120 having frames 122 joined by a connecting beam 124. These trolley frames mount rollers 126 which engage the rail 116 in the manner best shown in FIG. 9 to support trolleys for movement along the rail while restraining the trolleys against separation from the rail.

The concrete surfacing carriage 12 mounts a pair of rotary drums 128 on which are wound cables 130 for attachment to the trolleys 120. The carriage is thereby tethered or anchored to the trolleys in such as way that the trolleys and carriage can move together in the endwise direction of the rail 116 to plane the sloping surface 118 while the surfacing carriage is restrained against sliding sideways along the surface. The cable drums 128 are rotatable, either by hand or by hydraulic motors controlled from the console 86, to shorten or lengthen the length of cables 130 between the drums and the rail 116 to support the carriage at different distances from the rail. Thus, the cable lengths may be changed at the end of each pass of the carriage 12 along the surface to permit surfacing of different portions of the surface 118 on successive passes. With the arrangement of FIGS. 8 and 9, the carriage 12 may be propelled along the surface 118 by a winch 132 fixed at one end of the surface and having cables 134, 136 attached to the carriage and the trolleys 120, respectively, for pulling the carriage and trolleys in unison along the surface. Reverse movement of the carriage along the surface may be accomplished either by gravity, in the event the surface 118 slopes down in the latter direction of carriage movement, or by a second winch at the other end of the surface 118.

Figure 10:
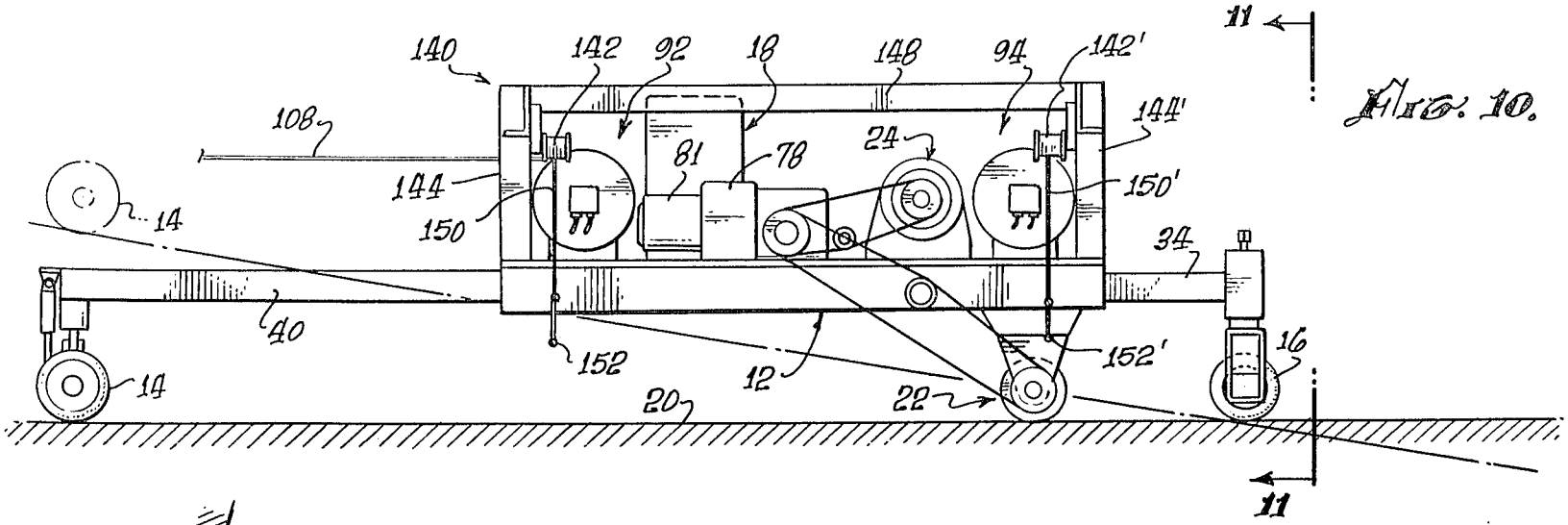
FIG. 10 is an elevational view of a modified form of the invention.
Figure 11:
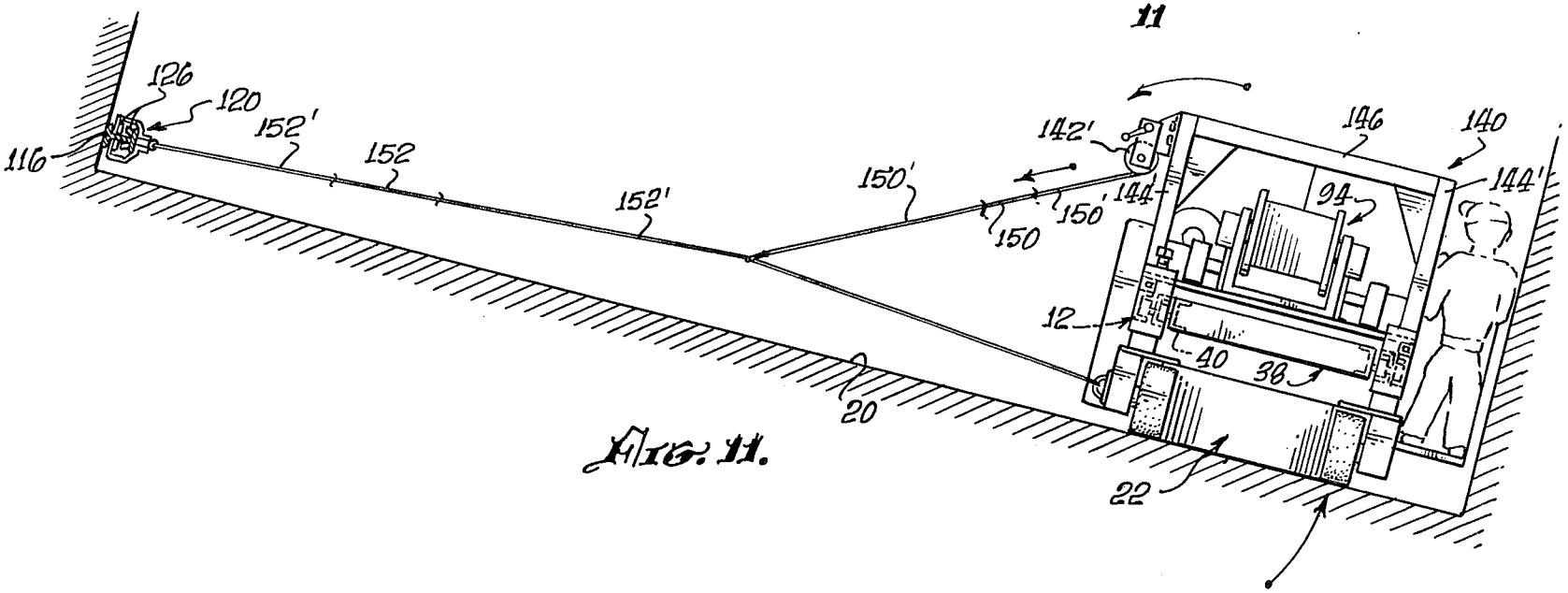
FIG. 11 is a view taken at line 11—11 in FIG. 10.

FIGS. 10 and 11 illustrate a modified form of the concrete surfacing machine of the invention, wherein an upper support frame 140 supports equalizing or relief winches 142, 142' in an elevated position. The machine of FIGS. 10 and 11 is otherwise generally similar to that hereinbefore described.

The upper support frame or sub-frame 140 extends substantially the width or length of the base frame 28, and is preferably fabricated of channel iron members, including vertical members 144, 144' welded to the base frame 28 atop frame portion 30, transverse horizontal members 146 and longitudinal members 148, these being secured together as by welding. Gussets are provided between the horizontal and vertical members, as shown. Rigid support is thus provided for the winches in elevated positions, such as three feet above the base frame. The winches are of conventional types, such as those utilized for towing yachts and boats onto trailers, having ratchets, multiple-speed operation, and a relatively high degree of adjustability or control.

Equalizing or relief cables 150, 150' are wound about the respective winches 142, 142' and are secured at their opposite ends to respective ones of tether or anchor cables 152, 152'. Each of the tether cables 152, 152' has one end secured to the base frame, as shown, and its opposite end to one of the trolleys 120 which operate along the rail, as earlier described in relation to FIGS. 8 and 9.

Referring to FIG. 11 it will be understood that operation of the relief or equalizing winches 142, 142' by the operator in appropriate manner to tighten or lengthen cables 150, 152 to a selected extent, applies pulling force or turning moment to the upper portion of the upper support frame 140, resulting in reducing or relieving the weight or load borne by the downward portion of the cutter assembly 22, when the surfacing machine is disposed on a lateral or transverse incline, as indicated in FIG. 11.

The operator is thus enabled to adjust the load on the lower portion of the cutter assembly, and thus to distribute or equalize the load across the cutter assembly in accordance with variations in the transverse or lateral angle of the surface being ground by the cutter assembly. The greater the angle of such slope, the greater the force exerted via the cables 150, 150' to relieve load at the lower portion of the cutter assembly. There is thus provided equal grinding action across the length of the cutter assembly, and en evenly ground surface across the length of the cutter.

The selective adjustment provided by the winches also serves to prevent overbalancing and tipping of the machine where the lateral angle of the surface being ground is substantial.

The inventor claims:

1. A concrete surfacing machine comprising:

a carriage including a frame, wheels at each end of said frame supporting said carriage for movement along a concrete surface to be worked, said frame including longitudinally telescoping portions at each end mounting said wheels for relative adjustment of said wheels lengthwise of said frame to vary said wheel spacing, adjusting means comprising means for relatively extending and contracting said frame portions, to adjust the wheels at each end of said frame lengthwise of said frame, and concrete surfacing means mounted on said frame between said wheels.

2. The concrete surfacing machine of claim 1 wherein:

said frame comprises a main frame portion between said wheels and frame means mounted at each end of the frame portion for longitudinal telescopic adjustment relative to said main frame portion, and mounting wheels for adjustment of the latter wheels lengthwise of said frame to vary said wheel spacing.

3. The concrete surfacing machine of claim 1, wherein:

said frame comprises a main frame portion between said wheels and front and rear end frame portions mounted on the respective ends of said main frame portion for longitudinal telescopic adjustment relative to said main frame portion, each of the frame portions mounting respective wheels for adjustment of the respective wheels at the frame ends to vary said wheel spacing, and said adjusting means comprises means for independently extending and contracting said front and rear end frame portions relative to said main frame portion.

4. The concrete surfacing machine of claim 1, wherein:

said frame has front and rear ends and said wheels include a pair of front wheels at said front frame end and a pair of rear wheels at said rear frame end, said frame includes a main central frame portion, a front frame portion mounted on the front end of the main frame portion for longitudinal telescopic adjustment relative to said main frame portion and mounting said front wheels for longitudinal adjustment relative to said main frame portion, and a pair of rear frame members mounted on the rear end of said main frame portion for longitudinal telescopic adjustment relative to said main frame portion and mounting said rear wheels for longitudinal adjustment relative to said main frame portion, and said adjusting means comprises means for independently adjusting said front telescoping frame portion and rear telescoping frame members to adjust said wheel spacing.

5. The concrete surfacing machine of claim 1 or claim 3 or claim 4, including:

means for vertically adjusting the wheels at the frame rear end relative to said frame, said rear wheels being positioned within the lateral extent of said concrete surfacing means to engage the concrete surface after surfacing thereof by the surfacing means to provide an accurate control reference for depth of cut by the surfacing means.

6. The concrete surfacing machine of claim 5, including:

means for independently vertically adjusting the front wheels relative to said frame.

7. The concrete surfacing machine of claim 3 including:

means for relatively vertically adjusting said wheels relative to said frame.

8. The concrete surfacing machine of claim 1 or claim 3, including:

means for independently vertically adjusting said wheels relative to said frame.

9. The concrete surfacing machine of claim 4, including:

power operated means for vertically adjusting said front wheels relative to said front frame portion, and means for independently vertically adjusting said rear wheels relative to said rear frame members.

10. A concrete surfacing machine according to claim 1 or claim 3, and further comprising:

propulsion means for propelling said carriage along said surface comprising winch and cable means for exerting a towing force on said carriage.

11. The concrete surfacing machine of claim 10, wherein:

said winch and cable means comprises a winch on said carriage including a cable to be anchored at its free end relative to said surface.

12. A concrete surfacing machine comprising:

a carriage including a base frame, and wheels on said frame supporting said carriage for movement along a concrete surface to be worked, concrete surfacing means on said carriage, and means spaced laterally from the carriage for supporting the carriage on a sloping concrete surface, guide means movable along said carriage supporting means, and cable means extending between the carriage and the supporting means for tethering said carriage to said guide means for movement of the carriage and guide means in unison lengthwise of said carriage supporting means.

13. The concrete surfacing machine of claim 12, wherein:

said carriage supporting means includes a guide rail anchored relative to said surface with the rail extending transverse to the slope of said surface.

14. A concrete surfacing machine comprising:

a carriage including a base frame, and wheels on said frame supporting said carriage for movement along a concrete surface to be worked, concrete surfacing means on said carriage, means for supporting said carriage on a sloping concrete surface, guide means movable along said carriage supporting means, and cable means for tethering said carriage to said guide means for movement of the carriage and guide means in unison lengthwise of said carriage supporting means, upper support frame means on the base frame, and equalizing winch means including a second cable secured to said upper support frame means to the tethering cable means at a point between the carriage and the guide means to produce force on the upper support frame means to equalize the load across said concrete surfacing means.

15. The concrete surfacing machine of claim 14, including:

a propulsion cable secured to said carriage and guide means for towing said carriage and guide means lengthwise of said rail.

16. The concrete surfacing machine of claim 14 or claim 15, wherein:

said tethering means comprises rotary drums on said carriage and cable extending between said drums and guide means, and means for rotating said drums to wind said cables on and unwind the cables from the drums.

17. The concrete surfacing machine of claim 14 or claim 15, including:

propulsion means for propelling said carriage along said surface comprising first winch and cable means for exerting a towing force on said carriage.

18. The concrete surfacing machine of claim 17, wherein:

said wheels are spaced lengthwise of said carriage, said surfacing means is located in the space between said wheels, and said carriage includes means for adjusting said wheel spacing.

* * * * *